US011845635B2

(12) United States Patent
Xiong et al.

(10) Patent No.: US 11,845,635 B2
(45) Date of Patent: Dec. 19, 2023

(54) ELEVATOR SYSTEMS, GUIDE RAIL ASSEMBLIES AND METHODS OF INSTALLING ELEVATOR SYSTEMS

(71) Applicant: Otis Elevator Company, Farmington, CT (US)

(72) Inventors: Bi Xiong, Châtillon-sur-Loire (FR); Vincent Lopez, Gien (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 17/830,654

(22) Filed: Jun. 2, 2022

(65) Prior Publication Data

US 2023/0141731 A1 May 11, 2023

(30) Foreign Application Priority Data

Nov. 5, 2021 (EP) ..... 21306553

(51) Int. Cl.

| | |
|---|---|
| ***B66B 7/02*** | (2006.01) |
| ***B66B 7/04*** | (2006.01) |
| ***B66B 17/12*** | (2006.01) |
| ***B66B 19/00*** | (2006.01) |

(52) U.S. Cl.

CPC ..... *B66B 7/026* (2013.01); *B66B 7/025* (2013.01); *B66B 7/046* (2013.01); *B66B 7/047* (2013.01); *B66B 17/12* (2013.01); *B66B 19/002* (2013.01)

(58) Field of Classification Search

CPC ..... B66B 7/024; B66B 7/025; B66B 7/026

See application file for complete search history.

(56) References Cited

U.S. PATENT DOCUMENTS

| | | | | |
|---|---|---|---|---|
| 4,117,908 A * | 10/1978 | Nara | B66B 7/06 187/254 |
| 9,359,172 B2 * | 6/2016 | Mangini | B66B 7/06 |
| 11,440,774 B2 * | 9/2022 | Castro Inzunza | B66B 7/06 |

(Continued)

FOREIGN PATENT DOCUMENTS

JP 2005170655 A 6/2005

OTHER PUBLICATIONS

Machine Translation of JP2007-119131.*

European Search Report for application EP 21306553.5, dated May 10, 2022, 25 pages.

*Primary Examiner* — Diem M Tran

(74) *Attorney, Agent, or Firm* — CANTOR COLBURN LLP

(57) ABSTRACT

An elevator system (2) comprising a hoistway (4), an elevator car (6) and a counterweight (8) arranged to move within the hoistway (4). The system (2) further includes a first counterweight guide rail and a second counterweight guide rail arranged to guide the counterweight within the hoistway (4) and a guide rail bracket (32) which connects the first and second counterweight guide rails together. An elevator machine (10) is arranged to drive a tension member (14), which couples the elevator car (6) and counterweight together (8), to move the elevator car (6) within the hoistway (4). The system (2) further includes a friction reducing element (36) arranged on the guide rail bracket (32) such that if the tension member (14) moves towards the guide rail bracket (32) during operation of the elevator system (2), the tension member (14) contacts the friction reducing element (36).

19 Claims, 6 Drawing Sheets

(56) References Cited

U.S. PATENT DOCUMENTS

| | | | | |
|---|---|---|---|---|
| 2016/0236905 | A1 | 8/2016 | Zerelles et al. | |
| 2018/0290862 | A1 | 10/2018 | Copeland et al. | |
| 2018/0327226 | A1* | 11/2018 | Miyajima | B66B 7/021 |

* cited by examiner

ELEVATOR SYSTEMS, GUIDE RAIL ASSEMBLIES AND METHODS OF INSTALLING ELEVATOR SYSTEMS

FOREIGN PRIORITY

This application claims priority to European Patent Application No. 21306553.5, filed Nov. 5, 2021, and all the benefits accruing therefrom under 35 U.S.C. § 119, the contents of which in its entirety are herein incorporated by reference.

TECHNICAL FIELD

The present disclosure relates generally to the field of elevator systems, to guiderail assemblies for counterweights used in elevator systems, and to methods of installing elevator systems.

BACKGROUND ART

In the design of elevator systems, there is often a desire to reduce the overall size of a hoistway within a building. Reducing the size of the hoistway may increase the amount of space available in a building which can be used for other purposes, e.g. for residential and/or commercial purposes. In reducing the overall size of the hoistway, it may, for example, be desirous to minimise the top-to-bottom height of the hoistway and/or minimise a side-to-side or back-to-front dimension of the hoistway.

Some elevator systems comprise an elevator machine which is arranged within the hoistway itself, rather than in a separate machine room. Such systems are often known as 'machine room-less systems'. Such machine room-less elevator systems may advantageously reduce the top-bottom height of the hoistway. In such machine room-less systems, the counterweight often runs along one side of the elevator car. Arranging the elevator machine within the hoistway can cause difficulties in arranging the other components of the elevator system in an appropriate manner.

SUMMARY OF THE DISCLOSURE

In accordance with a first aspect, the present disclosure provides an elevator system comprising: a hoistway; an elevator car and a counterweight arranged to move within the hoistway; a first counterweight guide rail and a second counterweight guide rail arranged to guide the counterweight within the hoistway; a guide rail bracket which connects the first and second counterweight guide rails together; an elevator machine arranged to drive a tension member, which couples the elevator car and counterweight together, to move the elevator car within the hoistway; and a friction reducing element arranged on the guide rail bracket such that if the tension member moves towards the guide rail bracket, the tension member contacts the friction reducing element.

It will thus be appreciated that aspects of the present disclosure provide an improved elevator system whereby if, e.g. during operation of the elevator system, the tension member moves within the hoistway towards the guide rail bracket, the tension member contacts the friction reducing element instead of contacting the guide rail bracket itself. The tension member may be wound upwards or downwards by the elevator machine when it moves towards the guide rail bracket. The provision of the friction reducing element which the tension member may contact, may thus prevent the tension member from dragging along the guide rail bracket during operation. This may reduce damage and/wear of the tension member which may extend the operational life of the tension member. The friction reducing element may also reduce the noise generated when the tension member moves towards the guide rail bracket, and thereby improve the ride experience for users of the elevator system. Further, by reducing the amount of drag, i.e. friction, experienced by the tension member, this may reduce the load experienced by the elevator machine itself which may reduce wear on the elevator machine and also reduce the power consumed in operation of the elevator system.

In a set of examples, the elevator machine comprises a traction sheave around which the tension member passes; and wherein the tension member extends between the traction sheave and a deflector sheave arranged on the elevator car. The deflector sheave may be arranged on the underside of the car such that the elevator car is supported in an 'underslung' arrangement. The elevator car may comprise a plurality of deflector sheaves, around which the tension member extends. The tension member may extend directly between the traction sheave and the deflector sheave. In some instances, it may not be possible to arrange a deflector sheave adjacent the elevator machine in order to guide the tension member within the hoistway. In such instances, the presence of the friction reducing element on the guide rail bracket may account for a lack of a deflector sheave adjacent the elevator machine. The traction sheave and/or the deflector sheave on the elevator car may have a diameter of less than or equal to 100 mm.

In a set of examples, the elevator car is arranged to move in a vertical direction within the hoistway and wherein a portion of the tension member extending from the deflector sheave arranged on the elevator car towards the elevator machine, extends in a plane which is angled with respect to the vertical direction. The elevator machine may be positioned, for example relative to a deflector sheave on the elevator car, such that the tension member extends in the angled plane. As will be appreciated by those skilled in the art, the angle at which the plane in which the tension member extends may change depending on the position of the elevator car within the hoistway. For example, when the elevator car is lower within the hoistway, the acute angle between the plane and the vertical direction may be larger than the acute angle between the plane and the vertical direction when the elevator car is at a higher position within the hoistway. The angle of the angled plane relative to the vertical direction may determine whether the tension member is brought into contact with the friction reducing element. For example, when the angle between the plane and the vertical is smaller, the tension member may be brought closer to the guide rail bracket, and thus contact the friction reducing element.

As discussed above, the tension member may not always be in contact with the friction reducing element, and may only contact the friction reducing element when the elevator car is at certain positions within the hoistway, e.g. when the tension member is at a particular range of angles relative to the vertical direction. In a set of examples, the elevator car is movable within a range within the hoistway, and wherein the friction reducing element is arranged such that the tension member contacts the friction reducing element during only a portion of the range of movement of the elevator car. In examples wherein the tension member is not always in contact with the friction reducing element, it will be appreciated that the friction reducing element serves to reduce the friction experienced by the tension member, rather than guide the tension member within the hoistway, as would be the case for a traditional deflector sheave adjacent the elevator machine. Reducing the amount which the tension member contacts the friction reducing element may further reduce wear on the tension member and/or the forces required to drive the tension member within the elevator system.

The friction reducing element may comprise any suitable element which has a lower coefficient of friction with the tension member, when it is in contact therewith, at least when compared to the tension member contacting the guide rail bracket without a friction reducing element. In a set of examples, the friction reducing element comprises a rounded surface which the tension member may contact in use. The rounded surface of the friction reducing element may reduce the friction experienced by the tension member, at least when compared to the tension member contacting an abrupt edge of the guide rail bracket. The rounded surface of the friction reducing element may thereby allow the tension member to pass over the guide rail bracket more easily. The rounded surface may be provided by an element attached to the guide rail bracket, or may be integrally provided with the guide rail bracket itself.

In another set of examples, the friction reducing element comprises a roller. The roller may comprise a rolling element which rolls with the tension member when it is in contact therewith. The rolling element may be mounted to the guide rail bracket by any suitable mounting means. The use of a roller may advantageously reduce the friction experienced by the tension member. As will be appreciated by those skilled in the art, when the tension member is hoisted upwards or released downwards, whilst in contact with the roller, the roller may roll with the tension member to facilitate the movement of the tension member with respect to the guide rail bracket. As such, the tension member may not drag against the friction reducing element, and thus wear of the tension member and noise generated within the system may be reduced.

The friction reducing element may be arranged at any suitable position on the guide rail bracket. In a set of examples, the friction reducing element is arranged on an upper side of the guide rail bracket. Positioning the friction reducing element on an upper side of the guide rail bracket may advantageously mean that the tension member is only in contact with the friction reducing element when the tension member extends at a certain angle within the hoistway. Reducing the amount that the tension member is in contact with the friction reducing element may reduce the wear of both the friction reducing element and the tension member thereby potentially reducing the amount of maintenance required for the elevator system.

In a set of examples, the friction reducing element comprises a friction reducing coating. The friction reducing coating may advantageously reduce the friction experienced by the tension member. The friction reducing coating may itself provide the friction reducing element, e.g. a friction reducing coating may be directly applied to the guide rail bracket. Alternatively, in examples comprising a friction reducing element which comprises a rounded surface or a roller, the friction reducing coating may be applied to the roller or the rounded surface. The friction reducing coating may comprise any coating which reduces friction, for example a Polytetrafluoroethylene (PTFE) coating.

The elevator system may comprise a plurality of guiderail brackets spaced along the length of the hoistway to support the counterweight guide rails. The friction reducing element may be positioned on any guiderail bracket within the elevator system which the tension member is likely to contact during use. In a set of examples, the elevator system comprises a plurality of guide rail brackets arranged to connect the first and second guide rails together, wherein the plurality of guide rail brackets are spaced along a length of the first and second guide rails, and wherein the friction reducing element is arranged on a guide rail bracket arranged in an uppermost position within the hoistway. The Applicant has recognised that in some configurations, the tension member may be most likely to contact the uppermost guide rail bracket. Accordingly, by arranging the friction reducing element on the uppermost guide rail bracket, this may reduce the friction experienced by the tension member. In some examples, the friction reducing element is only arranged on the guide rail bracket in the uppermost position within the hoistway.

The guide rail bracket functions to connect the counterweight guide rails and hold the counterweight guide rails at a fixed spacing with respect to one another. This may help to ensure that the counterweight runs smoothly through the guiderails. In a set of examples, the guide rail brackets may also be fixed to an internal wall of the hoistway. The guide rail brackets may be attached directly to the internal wall, or be attached via an intermediate mounting assembly.

In a set of examples, the elevator system further comprises at least one elevator car guide rail, and wherein the elevator car guide rail is supported by the guide rail bracket. The elevator car guide rail may thus be attached to the guide rail bracket. The guide rail bracket may therefore function to support both the counterweight guide rails and the at least one elevator car guide rail.

The elevator machine may be arranged in any suitable position within the elevator system. However, in a set of examples, the elevator machine is arranged within the hoistway. With the elevator machine arranged within the hoistway, the elevator system may be considered to be a machine room-less elevator system. The elevator machine may be offset within the hoistway with respect to the elevator car. With the elevator machine arranged in the hoistway, space constraints may, for example, prevent the use of deflector sheaves, arranged adjacent the elevator machine, for guiding the tension member towards the elevator car. Accordingly, the tension member may extend directly from the elevator machine, e.g. from a traction sheave thereof, to the elevator car. The tension member may thus extend at an angle within the hoistway, which may vary depending on the position of the elevator car. The presence of a friction reducing element on the guide rail bracket may advantageously help facilitate the presence of an elevator machine in the hoistway, particularly an elevator machine offset from the elevator car itself.

The tension member may comprise any number of ropes, steel cables, and/or coated-steel belts. In a set of examples, the tension member comprises at least one coated-steel belt. The use of a coated-steel belt may advantageously reduce the amount of space occupied by the tension member within the hoistway. The friction reducing element may be dimensioned so as to be appropriate for the tension member being used in the elevator system. For example, when the elevator system comprises a tension member in the form of a plurality of coated-steel belts, the friction reducing element may have a lateral dimension that matches that of the coated-steel belts. The friction reducing element may comprise a single element which the tension member comes into contact with or may comprise a plurality of elements which individual parts of the tension member contact.

According to another aspect of the present disclosure there is provided a guide rail assembly for guiding a counterweight within an elevator hoistway; the guide rail assembly comprising: a first counterweight guide rail and a second counterweight guiderail; a guide rail support bracket extending between the first and second counterweight guiderails; and a friction reducing element arranged on the guiderail support bracket.

The guiderail assembly, e.g. the friction reducing element, may comprise any of the features of the examples discussed above.

In a set of examples, the friction reducing element comprises a roller.

In a set of examples, the friction reducing element comprises a rounded surface.

In a set of examples, the friction reducing element is arranged on an upper side of the guide rail bracket.

In a set of examples, the guide rail assembly further comprises an elevator car guide rail connected to the guide rail support bracket.

According to a further aspect of the present disclosure there is provided a method of installing an elevator system, wherein the elevator system comprises: a hoistway; an elevator car and a counterweight arranged to move within the hoistway; a first counterweight guide rail and a second counterweight guide rail arranged to guide the counterweight within the hoistway; a guide rail bracket which connects the first and second counterweight guide rails together; and an elevator machine arranged to drive a tension member, which couples the elevator car and counterweight together, to move the elevator car within the hoistway; wherein the method comprises arranging a friction reducing element on the guide rail bracket such that if the tension member moves towards the guide rail bracket, the tension member contacts the friction reducing element.

The elevator system and friction reducing element may comprise any of the features discussed above with respect to the other aspects and examples of the present disclosure. Components of the elevator system, e.g. the hoistway, elevator car, counterweight, first and second guide rails, the guide rail bracket, and the elevator machine may already be installed and the method may therefore involve arranging the friction reducing element in an existing elevator system. Alternatively, the method may further comprise installing any number of the other components of the elevator system.

In a set of examples, the method comprises arranging the friction reducing element on an upper side of the guide rail bracket.

BRIEF DESCRIPTION OF THE DRAWINGS

Certain examples of the present disclosure will now be described with reference to the accompanying drawings, in which.

DETAILED DESCRIPTION

Figure 1:
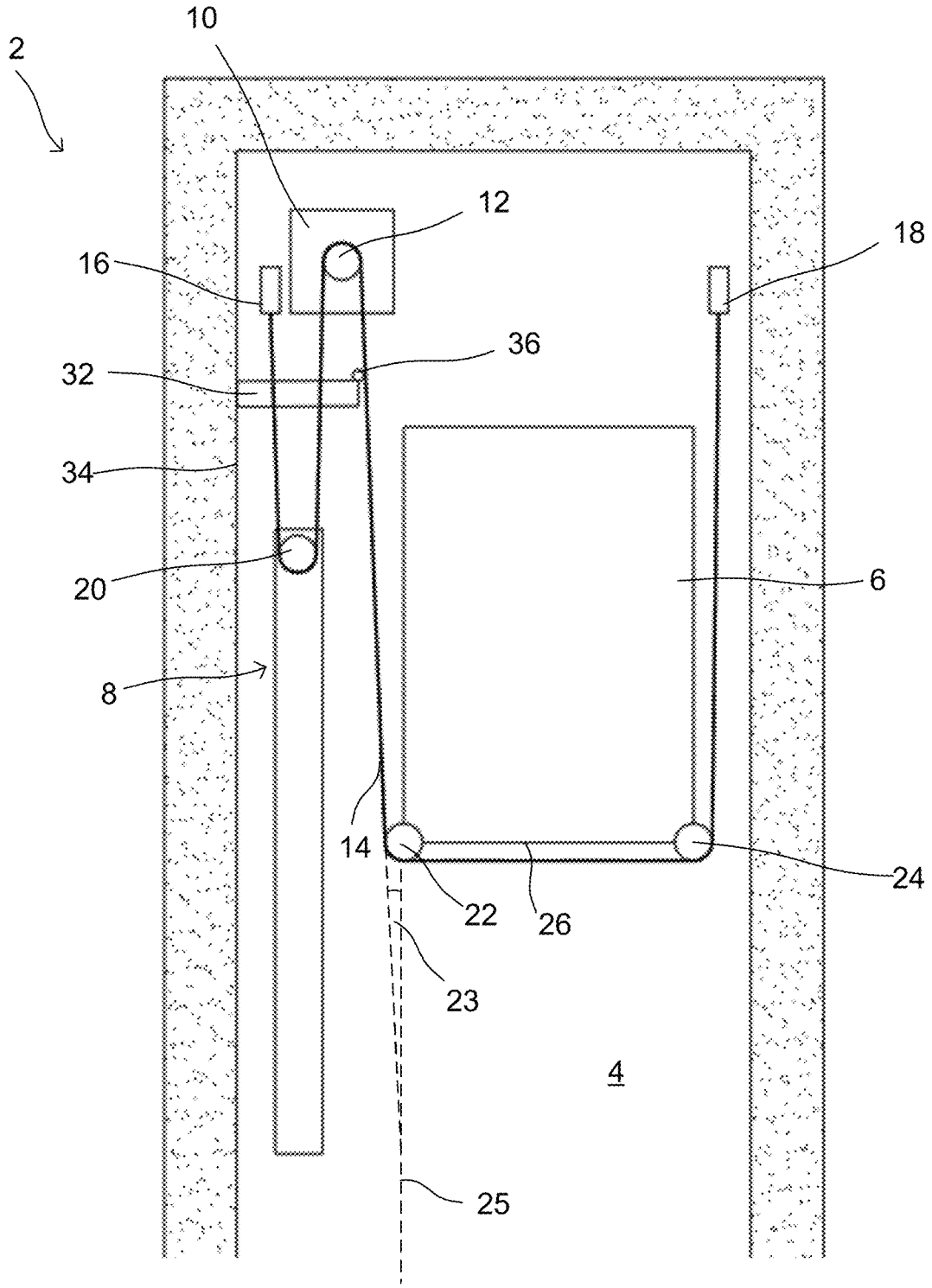
FIG. 1 is a schematic view of an elevator system in accordance with an example of the present disclosure, with the elevator car in a first position.

FIG. 1 is a schematic view of an elevator system 2 in accordance with an example of the present disclosure. The elevator system 2 comprises a hoistway 4. An elevator car 6 and counterweight 8 are arranged to move vertically within the hoistway 4. The counterweight 8 is configured to balance a load of the elevator car 6 and is configured to facilitate movement of the elevator car 6 concurrently and in an opposite direction with respect to the counterweight 8 within the hoistway 4.

Figure 2:
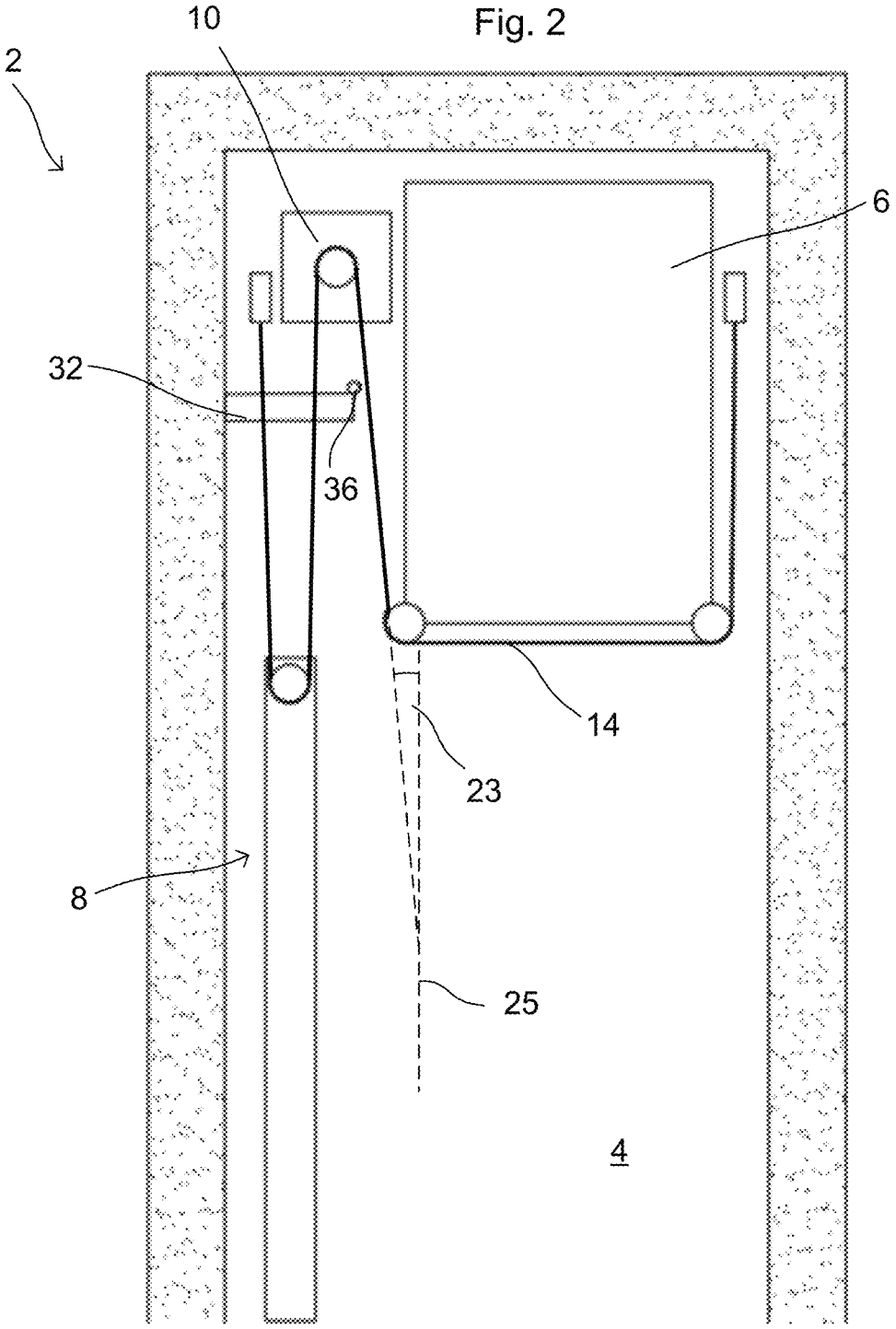
FIG. 2 is a schematic view of the elevator system shown in FIG. 1, with the elevator car in a second, higher position.

An elevator machine 10, which comprises a traction sheave 12, is also arranged within the hoistway 4. The elevator system 2 may thus be considered to be a machine room-less elevator system. The elevator machine 10 is offset with respect to the elevator car 6 such that the elevator car 6 can move to a position within the hoistway 4 whereby the elevator car 6 is at least partially adjacent the elevator machine 10. This is depicted in FIG. 2. Arranging the elevator machine 10 in the hoistway 4 may reduce the volume within a building which is occupied by the elevator system 2. Of course, the elevator machine 10 may be arranged in any other suitable manner.

The elevator machine 10 drives a traction sheave 12 to drive a tension member 14 which is coupled to the elevator car 6 and counterweight 8. The tension member 14 may include or be configured as, for example, ropes, steel cables, and/or coated-steel belts. The elevator machine 10 is configured to control movement between the elevator car 6 and the counterweight 8, and thus control the position of the elevator car 6 within the hoistway 4.

The tension member 14 extends between a first termination 16 and a second termination 18. The first and second terminations 16, 18 are points at which the tension member 14 is held in a fixed position within the hoistway 4. In the example depicted, the counterweight 8 comprises a first deflector sheave 20 around which the tension member 14 passes. The tension member 14 also passes around a second deflector sheave 22 and a third deflector sheave 24 arranged on the elevator car 6. In the example depicted, the second and third deflector sheaves 22, 24 guide the tension member 14 along an underside 26 of the elevator car 6. This arrangement is typically known as an 'underslung' arrangement. Of course, any other suitable arrangement of the tension member 14 with respect to the counterweight 8 and the elevator car 6 may be utilised and any number of deflector sheaves may be utilised.

When the elevator machine 10 drives the traction sheave 12 to rotate, the traction sheave 12 drives movement of the tension member 14 causing the elevator car 6 to move upwards, whilst the counterweight 8 simultaneously moves downwards, or cause the elevator car 6 to move downwards, whilst the counterweight 8 simultaneously moves upwards.

Figure 3:
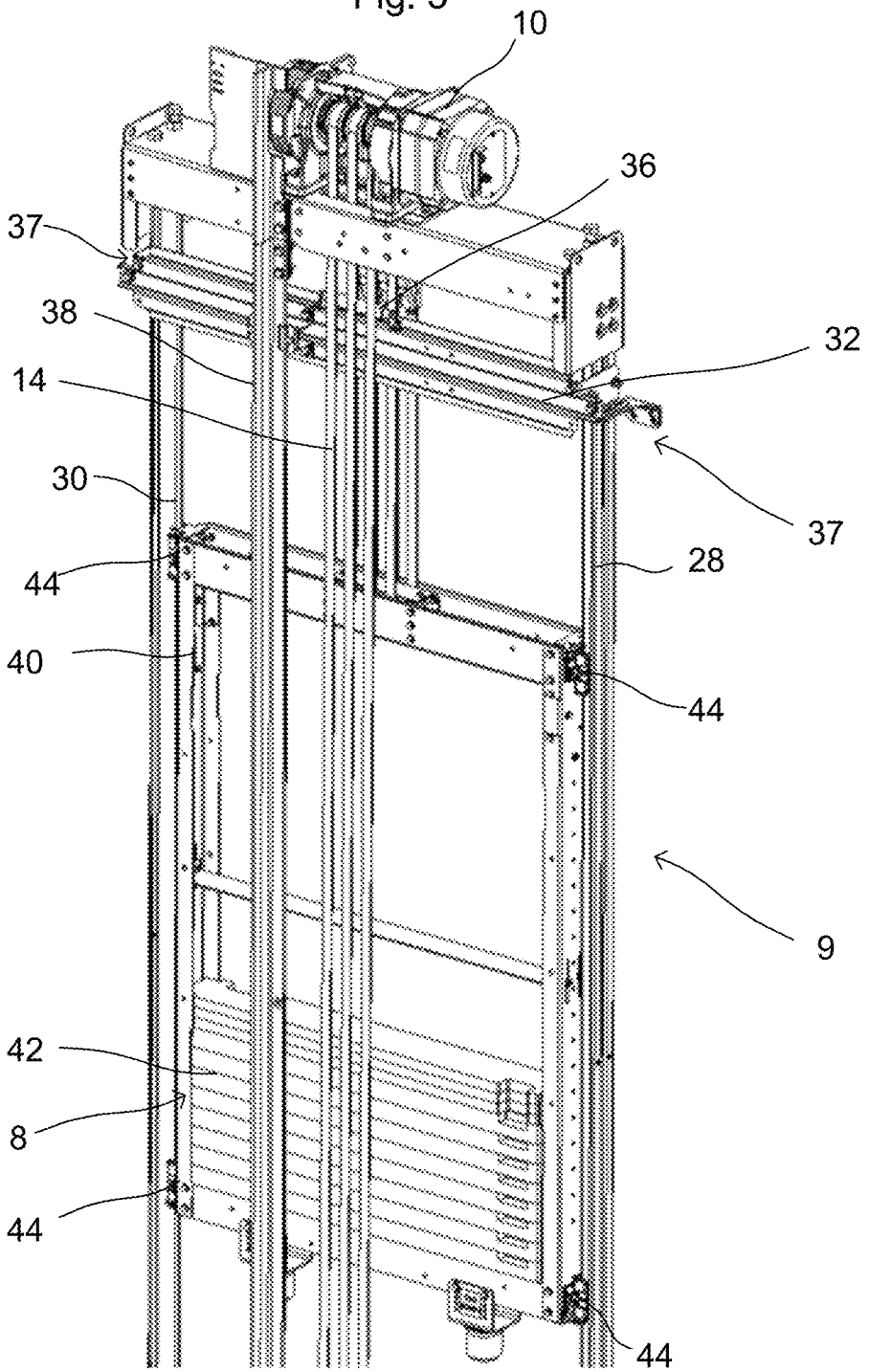
FIG. 3 is a perspective view of the counterweight guide rail assembly and elevator machine of the elevator system shown in FIG. 1.

Whilst not shown in FIG. 1, the counterweight 8 is constrained to move within the hoistway 4 along first and second counterweight guide rails 28, 30. These counterweight guide rails 28, 30 are shown in FIG. 3 and will be described in more detail below. The counterweight guide rails 28, 30 constrain the counterweight 8 to move vertically within the hoistway 4. Additionally, the elevator system 2 comprises at least one elevator car guide rail 38 (not shown in FIG. 1), which guides the elevator car 6 to move vertically within the hoistway 4. A guide rail bracket 32 extends between the first and second counterweight guide rails 28, 30 and acts to couple the first and second counterweight guide rails 28, 30 together. The car guide rail 38 may also be mounted to the guide rail bracket 32, as is shown in FIG. 3 and described in more detail below. The guide rail bracket 32 may be connected, for example via a wall mounting bracket (not shown in this Figure), to an inside wall 34 of the hoistway 4. In the example depicted in FIG. 1, a friction reducing element, in the form of a roller 36 is arranged on the guide rail bracket 32. The roller 36 will be described in more detail below with reference to FIGS. 3 to 6.

In the elevator system 2 depicted in FIG. 1, the tension member 14 extends directly from the elevator machine 10, specifically the traction sheave 12 thereof, to the second deflector sheave 22 on the elevator car 6. As a result, as the elevator car 6 moves within the hoistway 6, the angle 23 of the tension member 6 (i.e. the angle 23 of the plane in which the tension member 6 extends) with respect to a vertical direction 25 extending through the hoistway 4, changes depending on the position of the elevator car 6 within the hoistway. For example, as the elevator car 6 moves downwards within the hoistway 4, the angle 23 between the tension member 6 and the vertical axis 25 will reduce, which will result in the tension member 14 being brought closer to the guide rail bracket 32. The presence of the roller 36 advantageously means that even as the angle 23 of the tension member 14 reduces, the tension member 14 will not drag against the guide rail bracket 32 itself, and instead it will come into contact with the roller 36. The roller 26 will reduce the friction experienced by the tension member 14 and allow the tension member 14 to move more freely. As discussed previously, this may reduce wear on the tension member 14, which may reduce the amount of maintenance required as well as ensuring the safety of the elevator system 2. Additionally, it may reduce the load on the elevator machine 10 and may reduce the amount of noise generated during operation of the elevator system 2.

When the elevator car 6 is in the position shown in FIG. 1, the tension member 14 is in contact with the roller 36. The tension member 14 may remain in contact with the roller 36 as the elevator car 6 is lowered from the position shown in FIG. 1. The roller 36 may therefore roll with the tension member 14 as the elevator car 6 is raised and lowered. However, the tension member 14 may not always be in contact with the roller 36. FIG. 2 is a schematic view of the elevator system 2, shown in FIG. 1, wherein the elevator car 6 has been driven vertically upwards in the hoistway 4 by operation of the elevator machine 10. In moving the elevator car 6 upwards, the counterweight 8 has moved downwards within the hoistway 4. As depicted, the angle 23 between the tension member 14 and the vertical axis 25 has increased. As a result, in the position depicted in FIG. 2, the tension member 14 is no longer in contact with the roller 36. Thus, as will be appreciated, the roller 36 may serve to prevent the tension member 14 from directly contacting the guide rail bracket 32 when the elevator car 6 is in certain positions within the hoistway 4. As such, the tension member 14 may only contact the roller 36 for a portion of the range of movement of the elevator car 6 within the hoistway 4. Of course, even though the tension member 14 may not normally be in contact with the roller 36 at certain positions within the hoistway, if the tension member 14 were to be caused to sway for any reason, the tension member 14 may sway towards, and contact, the roller 36. The roller 36 may, therefore, prevent the tension member from contacting the guide rail bracket 32 in such instances.

FIG. 3 shows a perspective view of a counterweight guide rail assembly 9 which may be utilised in the elevator system 2 shown in FIG. 1. FIG. 3 shows the first and second guide rails 28, 30 which guide the counterweight 8. Also shown is an elevator car guide rail 38, which is coupled to the guide rail bracket 32. The elevator system 2 may comprise a further elevator car guide rail arranged opposite the elevator car guide rail 38 shown in FIG. 3. The further elevator car guide rail may, for example, be affixed to a wall of the hoistway 4. The counterweight 8 comprises a frame 40 which supports a plurality of weights 42. As will be appreciated by those skilled in the art, an appropriate number of weights 42 may be arranged within the frame 40 to balance the weight of the elevator car 6. The frame 40, of the counterweight 8, is guided along the first and second counterweight guide rails 28, 30 by four guide shoes 44. Whilst a specific form of counterweight 8 is illustrated and described above, any other suitable form of counterweight 8 may be utilised.

As depicted in FIG. 3, the roller 36 is arranged on the guide rail bracket 32 which is in an uppermost position, i.e. the guide rail bracket 32 which is closest to the elevator machine 10. The guide rail assembly 9 may comprise further guide rail brackets 32 arranged along the length of the first and second counterweight guide rails 28, 30, but which are not shown in this Figure. The guide rail bracket 32 couples the first and second counterweight guide rails 28, 30 together via mounting assemblies 37 arranged at each end of the guide rail bracket 32.

Figure 4:
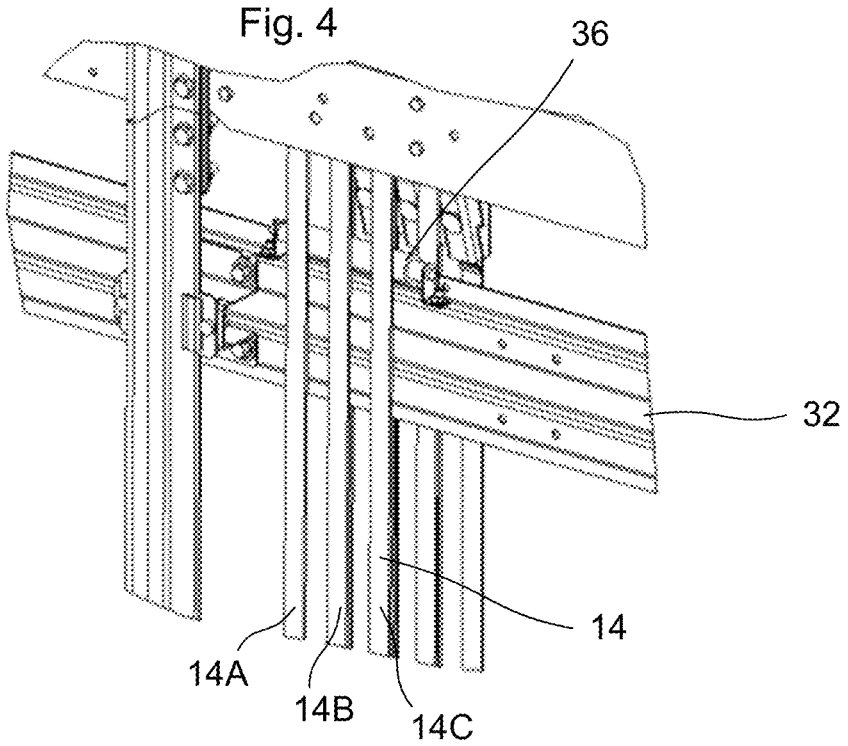
FIG. 4 is a close-up view of the friction reducing element shown in FIG. 3.

FIG. 4 shows a close-up view of the upper portion of the guide rail assembly 9 focusing on the guide rail bracket 32 and the roller 36 arranged thereon. As shown in this Figure, the tension member 14 comprises three sub-members 14A, 14B, 14C. The sub-members 14A, 14B, 14C may have any suitable form. For example, they may comprise coated-steel belts. Whilst three sub-members 14A, 14B, 14C are illustrated, it will be appreciated that the tension member 14 may comprise any number of sub-members. The roller 36 has a width which is greater than the lateral extent of the tension member 14, i.e. the lateral extent of the three sub-members 14A, 14B, 14C, such that the entire tension member 14 comes into contact with the roller 36 when the tension member 14 moves towards the guide rail bracket 32.

Figure 5:
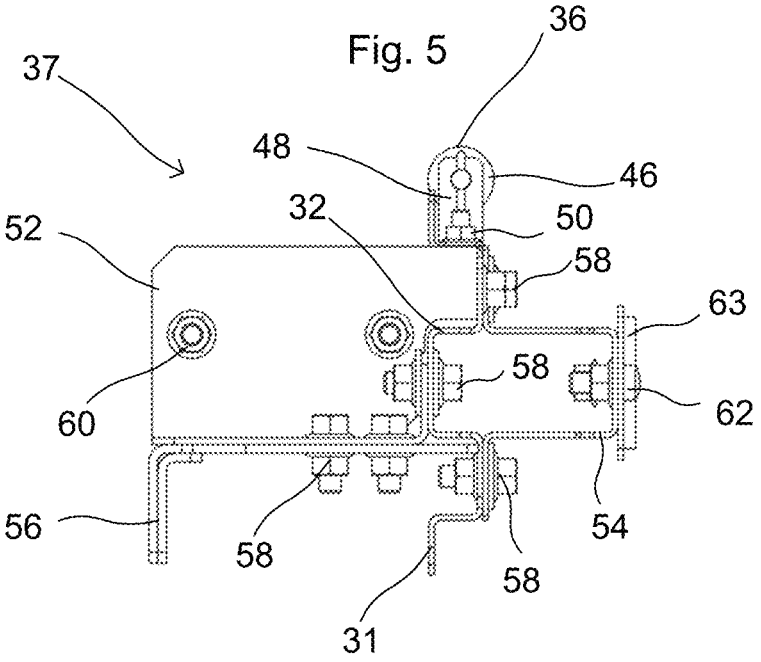
FIG. 5 is a side view of a mounting assembly.

FIG. 5 shows a side view of one of the mounting assemblies 37, shown in FIG. 3, which includes the guide rail bracket 32 and illustrates the further components that are mounted thereto. For reference, in the view shown in FIG. 5, an end face 31 of the guide rail bracket 32 is visible. As depicted, the roller 36 comprises a rolling element 46 which is mounted to the guide rail bracket 32 by two support brackets 48. The support brackets 48 are fixed in place by fixing elements 50. A counterweight guide rail support 52, a car guide rail support 54 and a wall mount 56 are also provided and secured together using a series of fixing elements 58. The car guide rail support 54 is attached to the guide rail bracket 32. The guide rail bracket 32 is fixed to the wall mount 56 and guide rail support 52 by fixing elements 58. Counterweight guide rail fixing elements 60 are provided on the counterweight guide rail support 52 and are used to secure the counterweight guide rails 28, 30 to the counterweight guide rail support 52. A car guide rail fixing element 62 is provided to fix the elevator car guide rail 38 to the car guide rail support 54, which is attached to the guide rail bracket 32. For example, the car guide rail fixing element 62 may secure a portion, e.g. a rear portion, of the car guide rail 38 to the car guide rail support 54. The car guide rail fixing element 62 may comprise a clamping plate 63 which secures the car guide rail 38 to the car guide rail support 54. Any number of car guide rail fixing elements 62 may be utilised. The mounting assembly 37 conveniently mounts, e.g. supports, the counterweight guide rails 28, 30, the elevator car guide rail 38 and the roller 36 arranged on the guide rail bracket 32. The wall mount 56 may be used to fix the mounting assembly to an internal wall 34 of the elevator system 2. The fixing elements described above may comprise any suitable fixing element, e.g. a nut and corresponding bolt.

Figure 6:
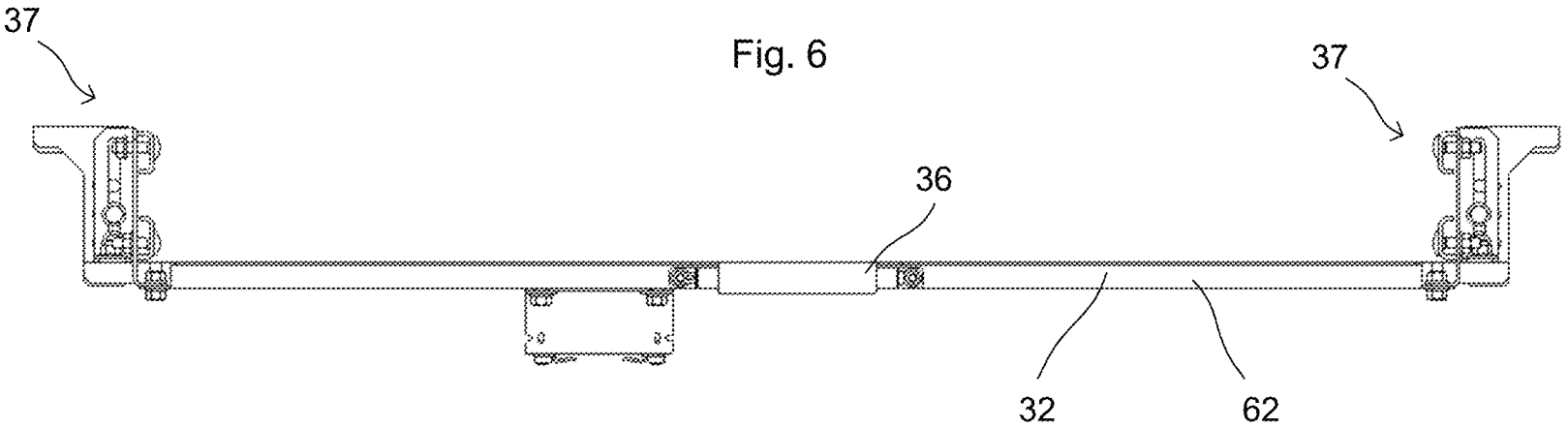
FIG. 6 is a top view of the guide rail bracket with the friction reducing element arranged thereon.

FIG. 6 shows a top view of the guide rail bracket 32, coupled at each end to the mounting bracket assemblies 37. As shown, the roller 36 is attached to a top surface 62 of the guide rail bracket 32 such that the roller 36 is arranged on an upper side of the guide rail bracket 32.

Figure 7:
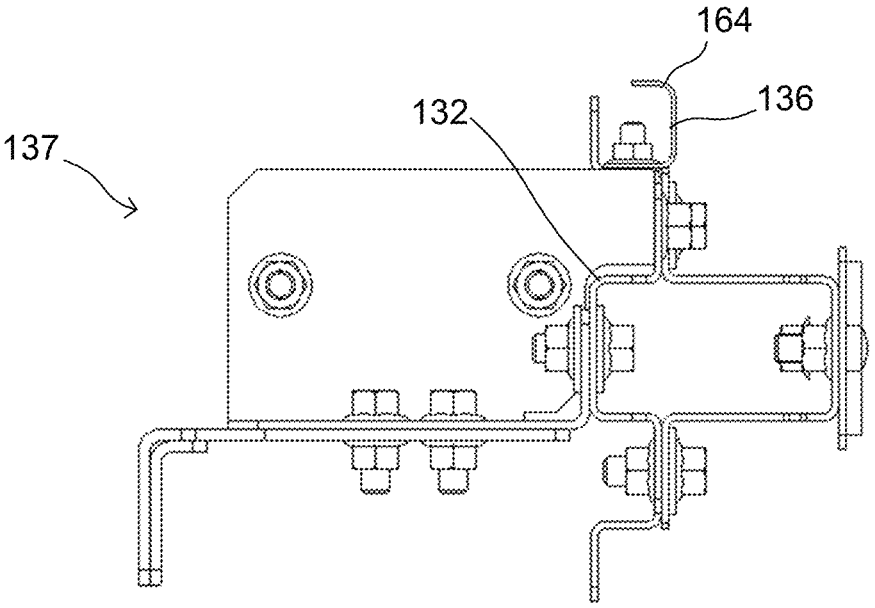
FIG. 7 is a side view of another mounting assembly which comprises a friction reducing element in accordance with another example of the present disclosure.

FIG. 7 shows a side view of another mounting assembly 137 which comprises a different form of friction reducing element 136. The mounting bracket assembly 137 is otherwise identical to the mounting bracket assembly 37 discussed above. Instead of a friction reducing element in the form of a roller 36, the friction reducing element 136 is a static element which comprises a rounded contact surface 164, which the tension member 14 may contact during operation of the elevator system. The friction reducing element 136 is mounted to the guide rail bracket 132. The rounded contact surface 164 of the friction reducing element 136 may reduce the friction experienced by the tension member 14, when compared to contacting the guide rail support bracket 132 directly. At least the rounded contact surface 164 may, in some examples, be coated with a friction reducing coating, for example PTFE. This may further reduce the friction experienced by the tension member 14.

Whilst two examples of a friction reducing element 36, 136 are depicted, it will be appreciated that any friction reducing element which reduces the friction experienced by the tension member 14 when it moves towards the guide rail bracket 32, 132 may be utilised.

With reference to the example depicted in FIGS. 1-6, according to some aspects of the present disclosure, a method of installing the elevator system 2 may comprise arranging the friction reducing element, i.e. the roller 36, on the guide rail bracket 32 such that if the tension member 14 moves towards the guide rail bracket, the tension member 14 comes into contact with the roller 36 rather than the guide rail bracket. The method may comprise appropriately arranging the roller 36 with respect to the guide rail bracket 32. For example, the method may comprise arranging the roller 36 so as to extend from an upper side of the guide rail bracket 32. The method may comprise arranging the roller 36 on the uppermost guide rail bracket 32 in the elevator system 2. The method may further comprising installing at least one, e.g. all, of the other components of the elevator system 2.

Accordingly, it will be appreciated by those skilled in the art that examples of the present disclosure provide an improved elevator system in which the friction experienced by the tension member of the system may be reduced. While specific examples of the disclosure have been described in detail, it will be appreciated by those skilled in the art that the examples described in detail are not limiting on the scope of the disclosure.

What is claimed is:

1. An elevator system comprising:

a hoistway;

an elevator car and a counterweight arranged to move within the hoistway;

a first counterweight guide rail and a second counterweight guide rail arranged to guide the counterweight within the hoistway;

a plurality of guide rail brackets arranged to connect the first and second guide rails together, wherein the plurality of guide rail brackets are spaced along a length of the first and second guide rails;

an elevator machine arranged to drive a tension member, which couples the elevator car and counterweight together, to move the elevator car within the hoistway; and a friction reducing element arranged on a guide rail bracket at an uppermost position within the hoistway, such that if the tension member moves towards the guide rail bracket, the tension member contacts the friction reducing element;

wherein the tension member comprises at least one coated-steel belt.

2. The elevator system of claim 1, wherein the elevator machine comprises a traction sheave around which the tension member passes; and wherein the tension member extends between the traction sheave and a deflector sheave arranged on the elevator car.

3. The elevator system of claim 1, wherein the elevator machine comprises a traction sheave around which the tension member passes; and wherein the tension member extends between the traction sheave and a deflector sheave arranged on the elevator car;

wherein the elevator car is arranged to move in a vertical direction within the hoistway and wherein a portion of the tension member extending from the deflector sheave arranged on the elevator car towards the traction sheave extends in a plane which is angled with respect to the vertical direction at an angle greater than zero degrees.

4. The elevator system of claim 1, wherein the elevator car is movable within a range within the hoistway, and wherein the friction reducing element is arranged such that the tension member contacts the friction reducing element during only a portion of the range of movement of the elevator car.

5. The elevator system of claim 1, wherein the friction reducing element comprises a rounded surface which the tension member may contact in use.

6. The elevator system of claim 1, wherein the friction reducing element comprises a roller.

7. The elevator system of claim 1, wherein the friction reducing element is arranged on an upper side of the guide rail bracket.

8. The elevator system of claim 1, further comprising at least one elevator car guide rail, and wherein the elevator car guide rail is supported by the guide rail bracket.

9. The elevator system of claim 1, wherein the elevator machine is arranged within the hoistway.

10. An elevator system comprising:

a hoistway;

an elevator car and a counterweight arranged to move within the hoistway;

a first counterweight guide rail and a second counterweight guide rail arranged to guide the counterweight within the hoistway;

a plurality of guide rail brackets arranged to connect the first and second guide rails together, wherein the plurality of guide rail brackets are spaced along a length of the first and second guide rails;

an elevator machine arranged to drive a tension member, which couples the elevator car and counterweight together, to move the elevator car within the hoistway; and a friction reducing element arranged on a guide rail bracket at an uppermost position within the hoistway, such that if the tension member moves towards the guide rail bracket, the tension member contacts the friction reducing element;

wherein the friction reducing element comprises a friction reducing coating.

11. The elevator system of claim 10, wherein the elevator machine comprises a traction sheave around which the tension member passes; and wherein the tension member extends between the traction sheave and a deflector sheave arranged on the elevator car.

12. The elevator system of claim 10, wherein the elevator machine comprises a traction sheave around which the tension member passes; and wherein the tension member extends between the traction sheave and a deflector sheave arranged on the elevator car;

wherein the elevator car is arranged to move in a vertical direction within the hoistway and wherein a portion of the tension member extending from the deflector sheave arranged on the elevator car towards the traction sheave extends in a plane which is angled with respect to the vertical direction at an angle greater than zero degrees.

13. The elevator system of claim 10, wherein the elevator car is movable within a range within the hoistway, and wherein the friction reducing element is arranged such that the tension member contacts the friction reducing element during only a portion of the range of movement of the elevator car.

14. The elevator system of claim 10, wherein the friction reducing element comprises a rounded surface which the tension member may contact in use.

15. The elevator system of claim 10, wherein the friction reducing element comprises a roller.

16. The elevator system of claim 10, wherein the friction reducing element is arranged on an upper side of the guide rail bracket.

17. The elevator system of claim 10, further comprising at least one elevator car guide rail, and wherein the elevator car guide rail is supported by the guide rail bracket.

18. The elevator system of claim 10, wherein the elevator machine is arranged within the hoistway.

19. The elevator system of claim 10, wherein the tension member comprises at least one coated-steel belt.

* * * * *